US012774063B2

(12) United States Patent
Nowé

(10) Patent No.: US 12,774,063 B2
(45) Date of Patent: Oct. 27, 2026

(54) FLOATING SOLAR PANEL SUPPORT ASSEMBLY

(71) Applicant: Profloating Holding B.V., Maasdijk (NL)

(72) Inventor: Willem Nowé, Maasdijk (NL)

(73) Assignee: PROFLOATING HOLDING B.V., Maasdijk (NL)

( * ) Notice: Subject to any disclaimer, the term of this patent is extended or adjusted under 35 U.S.C. 154(b) by 310 days.

(21) Appl. No.: 18/735,546

(22) Filed: Jun. 6, 2024

(65) Prior Publication Data

US 2024/0409194 A1 Dec. 12, 2024

(30) Foreign Application Priority Data

Jun. 9, 2023 (NL) ..... 2035064

(51) Int. Cl.
*B63B 35/44* (2006.01)

(52) U.S. Cl.
CPC ..... *B63B 35/44* (2013.01); *B63B 2035/4453* (2013.01)

(58) Field of Classification Search
CPC .. B63B 35/44; B63B 2035/4453; F24S 20/70; F24S 25/11; F24S 25/65; Y02E 10/50; H02S 20/00
See application file for complete search history.

(56) References Cited

U.S. PATENT DOCUMENTS

2008/0029148 A1 2/2008 Thompson
2018/0278199 A1* 9/2018 Chang ..... H02S 20/30

FOREIGN PATENT DOCUMENTS

CN 106218829 B * 9/2019 ..... B63B 35/44
WO 2013032245 A2 3/2013
WO WO-2020198618 A1 * 10/2020 ..... F24S 20/70

OTHER PUBLICATIONS

Search Report and Written Opinion for Netherlands Patent Application Serial No. 2035064, mailed Dec. 8, 2023.

* cited by examiner

*Primary Examiner* — Anthony D Wiest
(74) *Attorney, Agent, or Firm* — KDW Firm PLLC

(57) ABSTRACT

A floating solar panel support assembly includes a floating member, a solar panel and a support structure coupled to the floating member for supporting the solar panel at at least three panel connection points. The support structure includes at least one support member coupled to the floating member and two panel connection points, wherein the support member extends between the two panel connection points via the floating member for supporting said panel.

20 Claims, 4 Drawing Sheets

FLOATING SOLAR PANEL SUPPORT ASSEMBLY

CROSS-REFERENCE TO RELATED APPLICATIONS

This application claims priority to Netherlands Patent Application Serial No. 2035064, filed Jun. 9, 2023, the entirety of which application is incorporated by reference herein.

FIELD

The present invention relates to a floating solar panel support assembly comprising a floating member, a solar panel and a support structure coupled to the floating member for supporting the solar panel at at least three panel connection points.

Solar panels are a renewable energy source with great potential for producing electricity without emitting greenhouse gasses. However, the surface area required to be covered by solar panels to allow for sufficient capacity is not inconsiderable. To reduce the amount of land that is covered by solar panels, floating solar panel assemblies are known in the art. These assemblies may comprise floating members that float on the surface of a body of water, and that are provided with supports to hold a solar panel.

Assemblies of floating members and supports as known in the art are usually arranged to support solar panels with dimensions of roughly 1 m×1.6 m, which is the generally accepted standard for solar panels, at least at the moment. As technology progresses solar panels of larger size become available. To save on expensive semiconductor materials these larger solar panels, as well as solar panels of more standard size, are made with as little material as possible. A drawback of this is that these larger solar panels, as well as standard solar panels, possess less structural integrity of their own. A consequence of this is that the structures on which these solar panels are mounted have to be designed such that they adequately support these solar panels.

A problem with floating solar panel support assemblies, which comprise a floating member and supports, as known in the art, is that they do not adequately support solar panels of larger size or of standard size with low rigidity. Additionally, floating solar panel support assemblies ideally are resistant to bending forces applied to them by waves on the water surface on which they float. Floating solar panel support assemblies known in the art require complicated geometries to be sufficiently rigid.

SUMMARY OF THE DISCLOSURE

At least one of these problems, in addition to other problems, is solved by a floating solar panel assembly according to claim 1, more specifically by a floating solar panel support assembly comprising a floating member, a solar panel and a support structure coupled to the floating member for supporting the solar panel at at least three panel connection points, wherein the support structure comprises at least one support member coupled to the floating member and two panel connection points, wherein the support member extends between the two panel connection points via the floating member for supporting said panel.

Preferably, the outside perimeter of the floating member as seen from above defines a floating member footprint, wherein at least one of the two panel connection points to which the support member couples lies outside the floating member footprint. By extending the support member such that a panel connection point lies outside the footprint of the floating member the solar panel may be supported such that a smaller part of the solar panel extends outwards beyond the connection point. In this way the overhang is beneficially reduced, and the bending moment applied to the solar panel by the overhanging parts is reduced. Preferably, two panel connection points lay outside the floating member footprint.

In this embodiment, 'seen from above' is defined as a direction substantially perpendicular to the horizontal plane. The floating member is then oriented as if it were freely floating on water. In this embodiment, the floating member is preferably substantially box shaped, and the top and bottom surfaces of the floating member are then substantially parallel to the surface of the water. However, other embodiments of the floating member wherein the floating member is not box shaped, and/or wherein the top and bottom surfaces are not substantially parallel to the surface of the water are also envisioned.

As described, the support structure preferably comprises at least one support member coupled to the floating member and two panel connection points, wherein the support member extends between the two panel connection points via the floating member for supporting said panel. In the alternative, a support member extends between one connection point and the floating member only, wherein preferably the connection point to which the support members couples lies outside the floating member footprint.

Preferably, the support member comprises a tubular support member. A benefit of using tubular support members is that the tubular geometry possesses an advantageous combination of bending stiffness, torsional stiffness in any bending or torsion direction, and minimal use of material and therefore weight. Using tubular members therefore allows for great flexibility with regard to the geometry of the support structure while ensuring sufficient stiffness. The axial symmetry of tubular members also allows for them to be bent into a range of different geometries to suit the requirements of the specific solar panel to be mounted. As sizes of solar panels increase, more nonstandard sizes become available. It is therefore beneficial to employ a flexible solar panel support design to easily design support structures to suit different requirements.

Preferably, the at least one tubular support member comprises a tubular member bent in at least two locations, thereby preferably defining a support member middle section arranged to couple to the floating member, and preferably two support member upstanding sections arranged to couple to the solar panel. In this preferred arrangement the tubular support member is formed out of a single tube. Beneficially, the support member can then support the solar panel by itself, without requiring additional support, for example from the floating member. Additionally, the middle section that is attached to the floating member provides additional support to the floating member, requiring the floating member to be less stiff.

More preferably, at least one of the upstanding sections extends under a non-zero angle relative to the vertical. By extending one or more of the upstanding sections under an outward angle relative to the vertical the solar panel connection points may extend outwards beyond the footprint of the floating member, while the transitional bends between the upstanding section and the middle section of the support member preferably lays within the floating member footprint, and is therefore supported by the floating member. This beneficially increases stiffness compared to an arrangement wherein the upstanding members extend vertically, and the transitional bends are therefore outside of the floating member footprint thereby causing that the middle section overhangs beyond the edges of the floating member.

Preferably, at least one of one the support member upstanding sections comprises a connecting flange comprising a flattened section of the corresponding upstanding section. Alternatively, a separate connecting flange may be attached to the end of the upstanding section. By flattening the ends of the upstanding members an integral flange can be created. This reduces manufacturing complexity and increases structural integrity.

Preferably, the support structure further comprises at least one auxiliary support member extending between the floating member and a panel connection point, preferably at a first distance from the line drawn through the two connection points of the solar panel where a first support member connects to the solar panel. Optionally, the auxiliary support member connects to the floating member at a point at a second distance from the line drawn through the connection points where the first support member connects to the floating member. Preferably, the first and/or the second distances are nonzero. Such an auxiliary support member relieves the torsional load that would otherwise be applied to the support member middle sections. The use of one or more auxiliary support members ensures that the assembly of the solar panel and the support structure is in itself rigid and does not require external additional support, for example from the floating member. The rigidity of the support structure additionally and beneficially also supports the floating member, requiring it to be less stiff than when the support structure did not provide this support.

Preferably the auxiliary support member is coupled to the support member middle section. Connecting the auxiliary support member to the support member middle section additionally has the benefit that fewer connection points between the support structure and the floating member are required. Additionally, the auxiliary member can in this way transfer the load it bears directly to the support member middle section. This has the benefit that the floating member then does not have to transmit this load, requiring it to be less complicated and/or stiff.

Preferably the floating solar panel support assembly comprises a first and a second support member, preferably a first and second tubular support member, wherein also the second support member is coupled to the floating member and two respective panel connection points different from the panel connection points of the first support member. This arrangement beneficially fully supports the solar panel. As mentioned above, the support structure may beneficially significantly relieve the floating member from bending moments being applied to it as a consequence of supporting the solar panel. For this purpose it is preferred that the solar panel only connects to the support structure, thereby not directly loading the floating member. However, arrangements where part of the solar panel is supported by the support structure, and another part of the solar panel is supported directly by the floating member are also envisioned.

Preferably, the first support member is arranged on a first half of the floating member, and wherein the second support member is arranged on the opposing second half of the floating member. This beneficially ensures that the load of the solar panel is substantially evenly distributed over the floating member.

Preferably, the support member middle sections of the first and second support members extend substantially parallel. This beneficially allows for a simple geometry of the support members, and also ensures that the load of the solar panel is evenly distributed over the floating member.

Preferably, the middle sections of the support members extend substantially parallel to the long sides of the solar panel. Furthermore, preferably the first support member couples to two panel connection points at a first long side of the panel and wherein the second support member couples to two panel connection points at a second long side of the panel, opposite the first long side. This arrangement provides efficient support to the solar panel. This is especially beneficial if the solar panel is mounted at a tilt angle relative to the floating member, wherein the tilt comprises a rotation around the axis parallel to the long sides of the solar panel. In this way, one support structure can simply be constructed to extend higher than the other support structure. Additionally, the support members can each be constructed symmetrically in the plane perpendicular to their middle section bisecting said middle section. This simplifies manufacturing and allows for an even load distribution over each support member.

In an alternative embodiment the middle sections of the support members extend substantially parallel to the short sides of the solar panel. In this embodiment both support members are in mirror symmetry to each other, but individually asymmetrical. This embodiment has as a benefit that shorter lengths of tube may be required to construct the support members than in the previous embodiment.

Preferably the floating solar panel support assembly comprises a first and a second auxiliary support member, wherein also the second auxiliary support member extends between the floating member and a connection point of the solar panel, preferably at the non-zero distance as also mentioned above. In this way both support members are relieved of a moment load being applied to the support member middle sections. Beneficially, the floating member then does not have to support this moment load, but the support structure by itself is rigid. This beneficially only substantially loads the floating member in a vertical direction.

Preferably, the floating member comprises a hollow body comprising a top surface and an opposing bottom surface, wherein the floating member comprises at least one connection section for coupling the support member, wherein at a connection section the top and bottom surface are coupled allowing a fastener to pass without intersecting the internal volume. Preferably, a connection section comprises a conical segment extending from the bottom surface towards the top surface connecting the bottom surface and the top surface.

The hollow body provided buoyancy to the floating member. Additionally, the connection section that allows the fastener to pass without intersecting the internal volume has the benefit that the internal volume remains intact, and that there are no holes that require waterproofing to prevent water from entering the internal volume. Additionally, coupling the top and bottom surfaces at a number of locations increases the stiffness of the floating member as a whole, and it additionally provides additional support to both the top surface and the bottom surface.

Preferably, the middle section of the at least one support member comprises at least one, preferably two support member mounting holes for coupling to a connection section using for instance a fastener. By coupling the middle section of the support members at two locations to the floating member, the middle section is connected securely to the floating member, and may additionally provide support to the middle section. By limiting the number of mounting holes, and therefore limiting the number of connection sections the complexity of the floating member is limited. This preferred arrangement therefore provides a beneficial balance between secure connection of the support member to the floating member and a not overly complicated floating member.

Preferably, an auxiliary support member is connected to a support member and the floating member at a connection segment where the support member is connected to the floating member, wherein preferably a single fastener passes through the support member, the auxiliary support member and the connection segment in the floating member. This arrangement again beneficially limits the number of connection sections required, limiting complexity. Additionally, this arrangement simplifies the load paths through the structure, ensuring that the eccentrical, bending or torsional loads applied to whichever part of the support structure or the floating member is limited.

Preferably the supporting structure is connected to the floating member by means of a plurality of fasteners, wherein any of the fasteners connecting the supporting structure to the floating member comprise threaded fasteners, such as bolts or screws, with preferably a diameter larger than the diameter of a corresponding mounting hole in the floating member. Preferably, the one or more fasteners connecting the supporting structure to the floating member are at least partially made of a harder material, such as metal, and the floating member is at least partially made of a softer material, such as plastic, wherein the fastener forms threading in the corresponding mounting hole when the fastener is screwed into the mounting hole. This arrangement beneficially removes the need for example a nut accompanying for example a bolt to form the fastener. In this way, the support structure can be connected to the floating member while only requiring access to the top of the floating member. This also allows the floating member to float on the water when the support structure is connected, because no access to the bottom of the floating member is required. This arrangement additionally has the benefit that the risk of dropping the nut or such that would otherwise be required in the water is eliminated.

Preferably the floating member comprises four sides connecting the bottom surface and the top surface of the floating member, wherein each of the four sides is arranged perpendicular to the two neighbouring sides thereby forming a box, wherein at least one side and the directly opposite side is arranged with float connecting members. Alternative, any other side may be provided with float connecting members. Arranging the float connecting members only on opposing sides of the floating member allows a theoretically unlimited number of floating members to be interconnected in a chain like fashion. This allows for a beneficial arrangement of a plurality of floating members in an assembly of floating solar panel supports.

Preferably one or more float connecting members on one side of the floating members are arranged at one or more distances from a perpendicular side neighbouring the side on which the float connecting members are arranged, wherein a vertical plane of symmetry extends parallel to the one side and the opposite side provided with float connecting members, wherein consequentially the floating member and the locations of the two or more float connecting members are symmetrical across the plane of symmetry. This arrangement ensures that floating members may be arranged in a mutually aligned fashion 'head to tail' whereby the float connecting members overlap, allowing a float connector to pass through the float connecting members.

Preferably, the one or more float connecting members extend in a direction with a component perpendicular to the side from which the float connecting member extends, without a component perpendicularly outwards from the two sides neighbouring the side from which the float connecting member extends. This arrangement ensures that no members protrude from two opposing sides of the floating member, which may provide benefits such as mentioned above.

Preferably, a float connecting member comprises one or more connecting lugs, wherein the one or more connecting lugs extend one or more vertical distances relative to the top surface of the floating member, wherein a directly opposite float connecting member comprises one or more connecting lugs that extend at one or more different vertical distances relative to the top surface of the floating member, such that when two floating members are placed end to end the connecting lugs of the sides of the floating members closest to each other overlap. In this arrangement two float connecting members of neighbouring floating members may interlink, providing increased strength of the connection compared to an embodiment with only one connecting lugs extending from each of the two floating members. Additionally, by 'staggering' the float connecting lugs it is possible to interconnect two or more aligned floating members.

Preferably, one or more float connecting members comprise one or more holes. In this arrangement a float connector may pass through these holes, thereby making a connection between two floating members.

Another aspect relates to a support member, preferably a tubular support member, for use in a floating solar panel assembly as described above.

Another aspect relates to a kit of parts comprising a floating member and a support member, preferably a tubular support member, and optionally a solar panel for assembling a floating solar panel assembly as described above.

BRIEF DESCRIPTION OF THE DRAWINGS

Embodiments of the invention are further elucidated by means of the appended figures. These serve to explain the embodiments and not to limit the scope of the claims in any way.

DETAILED DESCRIPTION

Figure 1:
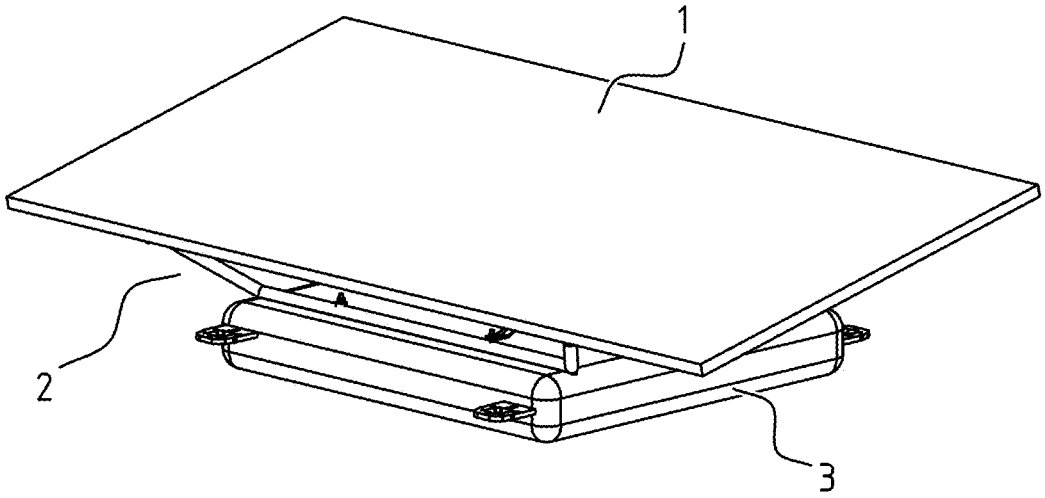
FIG. 1: an overview of the floating solar panel support assembly.

FIG. 1 shows an overview of the floating solar panel support assembly. The assembly globally comprises three parts; a solar panel 1, a support structure 2 and a floating member 3.

Figure 2:
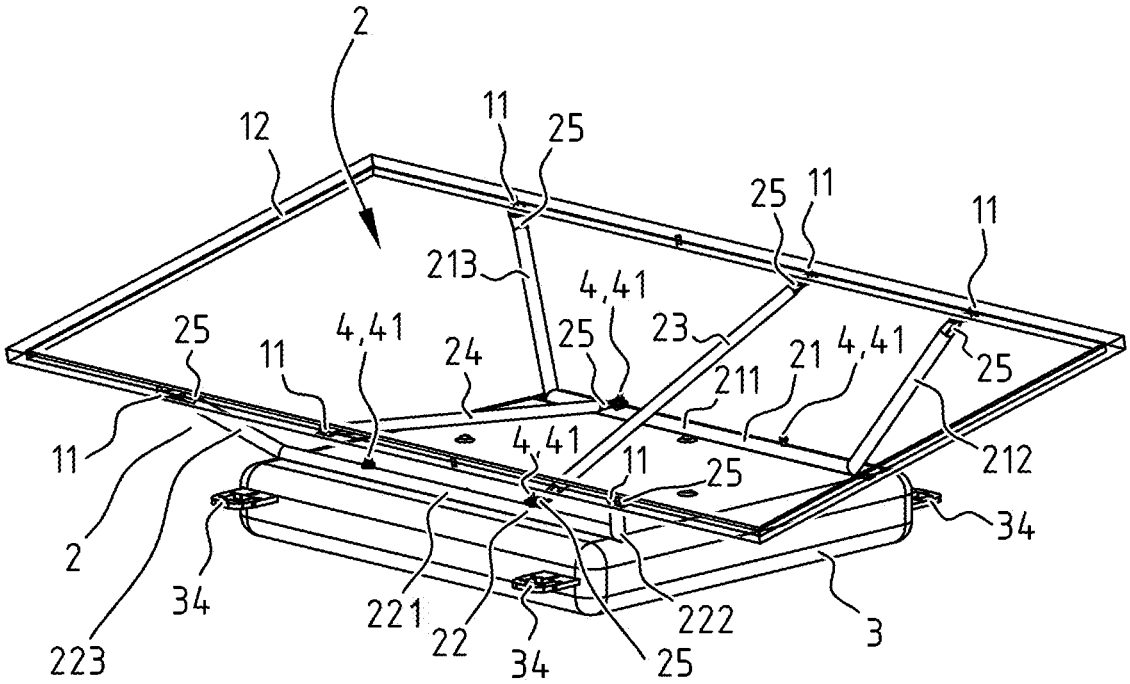
FIG. 2: an overview of the floating support assembly with the solar panel made transparent.

FIG. 2 shows a more detailed overview of the floating solar panel support assembly. The support structure 2 comprises two support members 21, 22 and two auxiliary support members 23, 24. The support members 21, 22 each comprise a tubular member bent in two locations, thereby forming a support member middle section 211, 221 and two upstanding sections 212, 213, 222, 223. The two support members 21, 22 are connected to the floating member at four mounting locations 4, wherein each support member middle section 211, 221 is connected at two mounting locations 4.

The middle sections 211, 221 extend substantially parallel to each other. The upstanding sections 212, 213, 222, 223 are all provided with flanges 25 at their ends, which comprise a hole and connect to the solar panel 1, for example at mounting points 11 provided in a solar panel frame 12 which surrounds and supports the panel 1. The flanges 25 may be constructed by flattening the ends of the tubular members. The upstanding sections 212, 213, 222, 223 extend upwards, and outwards. The solar panel mounting points 11 thus extend to beyond the footprint of the floating member 3. This allows a solar panel 1 to be adequately supported on a floating member 3 with a considerably smaller area, or footprint. The parts of the solar panel 1 extending beyond the mounting points 11 are unsupported and therefore result in a bending load applied to the solar panel 1, which is not beneficial.

The support structure 2 further comprises two auxiliary support members 23, 24 extending between a support member middle section 211, 221 and a mounting point 4 in the direction of the side of the solar panel 1 opposite to the side the auxiliary member 23, 24 originated from. Without these auxiliary support members 23, 24 the weight of the solar panel applied to the moment arms formed by the upstanding sections would apply considerable moment load around an axis parallel to the support member middle sections 211, 221 which would then be transmitted to the floating member 3 through the fasteners 41. The auxiliary members 23, 24 are provided with flanges 25 on both ends. One flange 25 of each auxiliary member 23, 24 connects to a mounting location 4 where a support structure middle section 211, 221 also connects to the floating member 3. The other flange 25 connects to a mounting point 11 on the solar panel 1, and/or on the solar panel frame 12.

Figure 3:
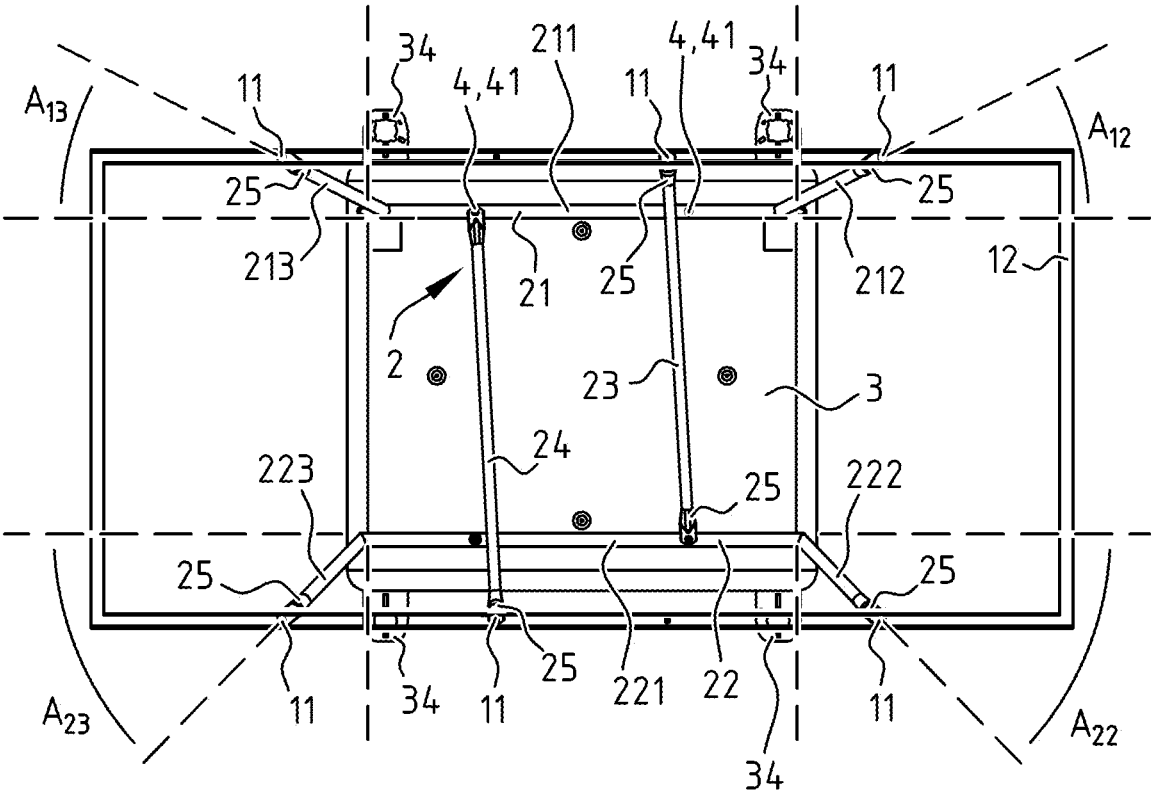
FIG. 3: a top view of the floating support assembly.

FIG. 3 shows a top view of the floating solar panel support structure as described above. The same parts are indicated as in FIG. 2. The upstanding sections 212, 213, are arranged at angles $A_{12}$, $A_{13}$ relative to a line extending parallel to the middle section 211. $A_{12}$, $A_{13}$ are preferably the same, but this is not required. Accordingly, the upstanding sections 222, 223, are arranged at angles $A_{22}$, $A_{23}$ relative to a line extending parallel to the middle section 221. $A_{22}$, $A_{23}$ are preferably the same, but this is not required. The angles may be chosen such that optimal support of the solar panel 1 is achieved.

Figure 4:
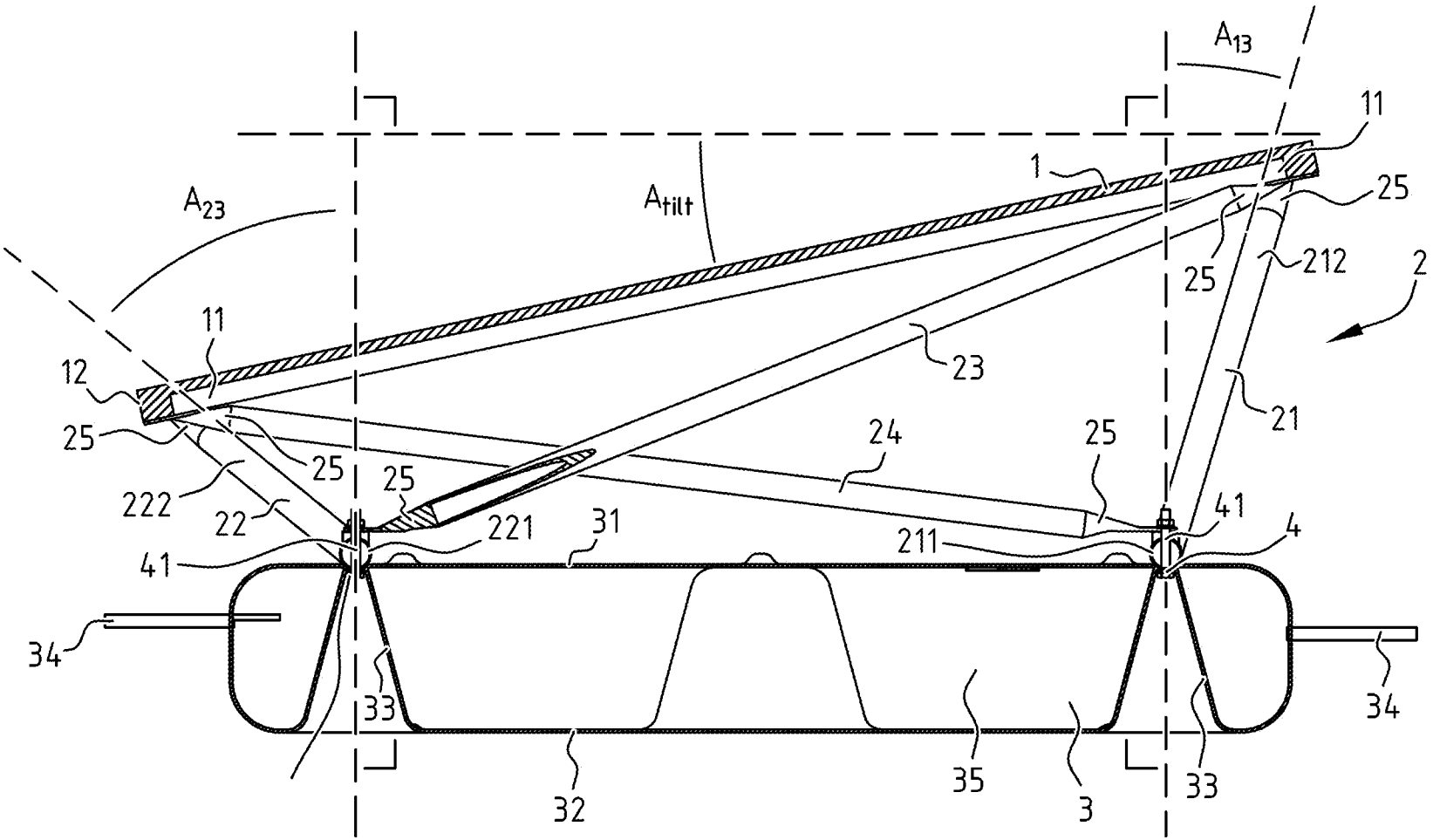
FIG. 4: a cross section view of the floating support assembly.

FIG. 4 shows a cross section view of the floating solar panel support assembly. The upstanding section 222 is angled outwards at an angle $A_{23}$ relative to the vertical direction, which is parallel to the bottom of the floating member 32. Section 223 (not shown) is preferably angled at the same angle $A_{23}$. Accordingly, the upstanding section 212 is angled outwards at an angle $A_{13}$ relative to the vertical direction, which is parallel to the bottom of the floating member 32. Section 213 (not shown) is preferably angled at the same angle $A_{23}$.

The construction of the floating member 3 is also shown in more detail in FIG. 4. The floating member 3 comprises an outside skin which encloses a volume 35 which provides buoyancy. The floating member 3 is substantially box-shaped, and comprises a top surface 31 and a bottom surface 32. Preferably, these extend parallel to each other.

Additionally, the bottom surface 32 may comprise conical segments 33 where the bottom surface 32 extends upwards and connects to the top surface 31. At the location where the top surface 31 and bottom surface 32 connect a mounting hole 4 may be arranged. These conical segments 33 on the one hand allow for a mounting hole to extend from the top of the floating member to the bottom without intersecting the volume 35. The support members 21 and 22 connect to the floating member 30 through holes 4 arranged in a conical segment 33. A fastener 41 is preferably passed through a hole in a middle segment 211, 221 and the mounting hole 4. Preferably, the fastener 41 comprises a self-tapping screw or the like, with a diameter larger than the mounting hole 4. When the fastener 41 is then screwed into the mounting hole 4 it cuts threading. The use of a self-tapping screw or the like has the benefit that it is not required to access the underside of the floating member 30 to thread a nut onto a bolt if that bolt serves as fastener 41.

Additionally, an auxiliary support member 23, 24 may be connected by a fastener passing through both the auxiliary support member 23, 24 and a support member middle segment 211, 221. This reduces the total amount of fasteners 41 and mounting holes 4 required.

The solar panel 1 may be mounted at an angle Atilt relative to the plane parallel to the bottom 31 of the floating member 3. To achieve this tilt angle, the lengths of the upstanding members 212, 213, 222, 223 and/or the angles of the upstanding members $A_{23}$, $A_{13}$ may be adjusted. Accordingly, the lengths of the auxiliary support members 23, 24 may be adjusted to fit. It should be noted that in FIG. 4 only a tilt angle Atilt around an axis parallel to the support member middle sections 211, 221 is applied. If desires, a tilt angle around an axis perpendicular to the middle sections 211, 221 may also be applied.

Figure 5:
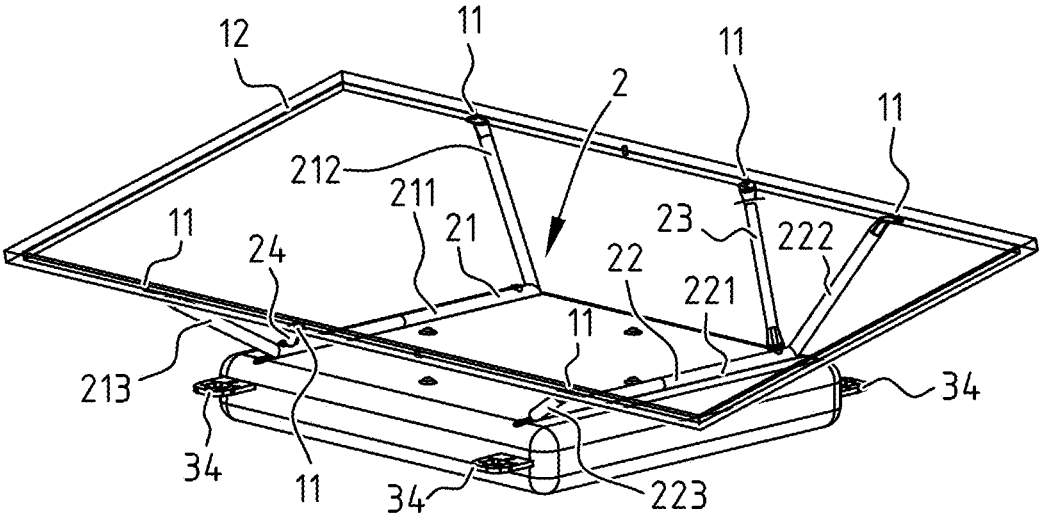
FIG. 5: an overview of an alternative embodiment of the floating support assembly.
Figure 6:
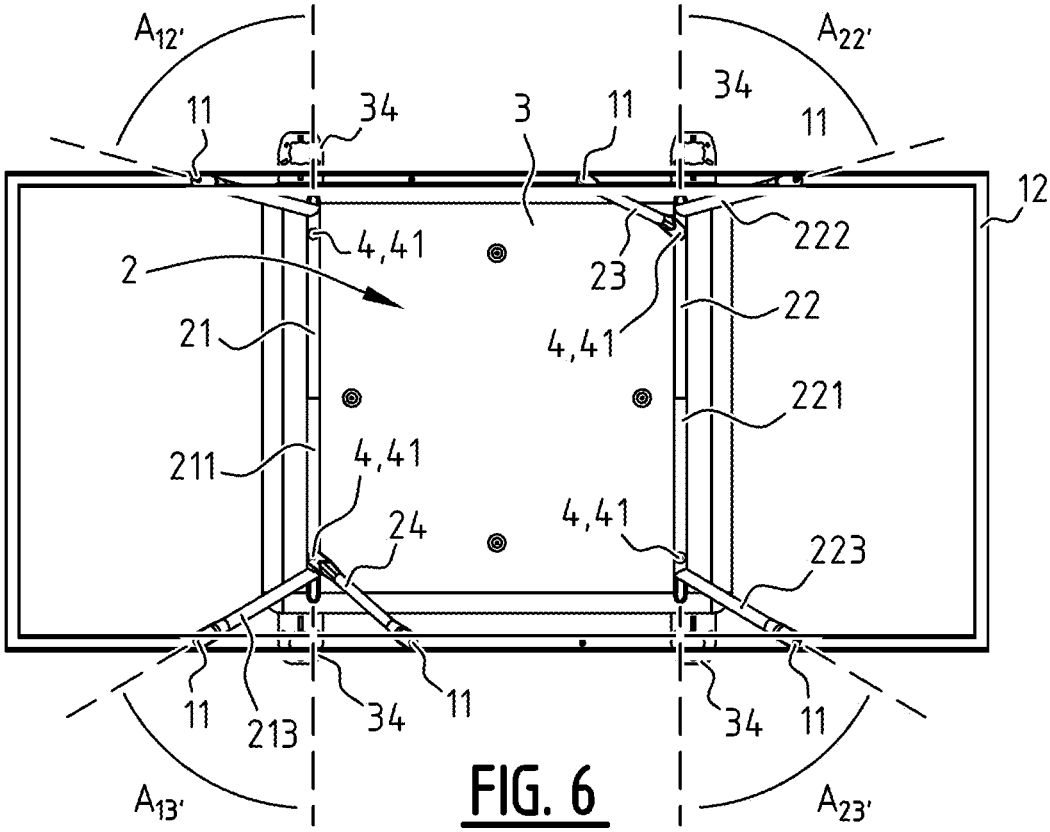
FIG. 6: a top view of the alternative embodiment of the floating support assembly.

FIGS. 5 and 6 show an alternative arrangement of the support members 21, 22 and the auxiliary support members 23, 24, wherein they are essentially rotated a quarter of a turn relative to the embodiment shown in FIGS. 1-4. It may be noted that in the arrangement shown in FIGS. 5 and 6 the support members 21, 22 are no longer individually symmetrical, such as in the embodiment shown in FIGS. 1-4. However, the arrangement of the two support members 21, 22 is symmetrical across the plane bisecting the floating member parallel to the middle sections 211, 221.

In this embodiment, the angles by which the two upstanding sections of a single support member 21 or 22 extend outwards may differ, while the angles by which two neighbouring upstanding sections of opposing support members may be the same. In other words, angles $A_{12'}$ and $A_{22'}$ may be the same, and angles $A_{13'}$ and $A_{23'}$ may be the same. It should additionally be noted that the auxiliary support members 23, 24 are arranged differently, but still perform the same functions in essentially the same way as in the embodiment shown in FIGS. 1-4. In the embodiment of FIGS. 5 and 6, each auxiliary member extends inwards from the middle section to which it is attached, while the upstanding sections of the respective support member extend outwards. The auxiliary members 23, 24 therefore relieve the moment that would otherwise be applied to the middle sections 21, 22 and the fasteners 41 by the weight of the solar panel combined with the moment arm of the extending upstanding sections.

FIGS. 1-6 additionally show connecting members 34, comprising flanges that extend from the sides of the floating member 3. In this embodiment, the connecting members 34 are only applied to two opposing sides. This allows a theoretically unlimited number of floating members 3 to be chained to each other. In this embodiment the connecting members 34 extend only in a direction perpendicular to the sides they extend from. An embodiment wherein the connecting members 34 also extend in a direction with a component parallel to the sides they extend form, thereby protruding beyond the sides not provided with connecting members 34 is also envisioned.

The invention claimed is:

1. A floating solar panel support assembly, comprising:

a floating member, a solar panel and a support structure coupled to the floating member for supporting the solar panel at at least three panel mounting points, wherein the support structure comprises at least one support member coupled to the floating member and two panel mounting points, wherein the support member extends between the two panel mounting points via the floating member for supporting said panel, wherein the outside perimeter of the floating member as seen from above defines a floating member footprint, and wherein at least one of the two panel mounting points to which the support member couples lies outside the floating member footprint.

2. The floating solar panel support assembly according to claim 1, wherein the at least one support member comprises a member bent in at least two locations, thereby defining a support member middle section arranged to couple to the floating member, and two support member upstanding sections arranged to couple to the solar panel.

3. The floating solar panel support assembly according to claim 2, wherein at least one of one the support member upstanding sections comprises a connecting flange comprising a flattened section of the corresponding upstanding section.

4. The floating solar panel support assembly according to claim 2, wherein the support structure further comprises at least one auxiliary support member extending between the floating member and a panel mounting point at a first distance from the line drawn through the two mounting points of the solar panel where a first support member connects to the solar panel, wherein the auxiliary support member connects to the floating member at a point at a second distance from the line drawn through the mounting points where the first support member connects to the floating member, and wherein the first and the second distances are not the same, and wherein the auxiliary support member is coupled to the support member middle section.

5. The floating solar panel support assembly according to claim 2, comprising a first and a second support member, wherein also the second support member is coupled to the floating member and two respective panel mounting points different from the panel mounting points of the first support member, and wherein the support member middle sections of the first and second support members extend substantially parallel.

6. The floating solar panel support assembly according to claim 5, wherein the middle sections of the support members extend substantially parallel to the long sides of the solar panel.

7. The floating solar panel support assembly according to claim 5, wherein the middle sections of the support members extend substantially parallel to the short sides of the solar panel.

8. The floating solar panel support assembly according to claim 2, wherein the floating member comprises a hollow body comprising a top surface and an opposing bottom surface, wherein the floating member comprises at least one connection mounting section for coupling the support member, wherein at a connection section the top and bottom surface are coupled allowing a fastener to pass without intersecting the internal volume, and wherein the middle section of the at least one support member comprises at least one support member mounting hole for coupling to a connection section using for instance a fastener.

9. The floating solar panel support assembly according to claim 1, wherein the support member is tubular.

10. The floating solar panel support assembly according to claim 1, wherein the support structure further comprises at least one auxiliary support member extending between the floating member and a panel mounting point at a first distance from the line drawn through the two mounting points of the solar panel where a first support member connects to the solar panel, wherein the auxiliary support member connects to the floating member at a point at a second distance from the line drawn through the mounting points where the first support member connects to the floating member, and wherein the first and the second distances are not the same.

11. The floating solar panel support assembly according to claim 10, wherein a connection section comprises a conical segment extending from the bottom surface towards the top surface connecting the bottom surface and the top surface, and wherein an auxiliary support member is connected to a support member and the floating member at a connection segment where the support member is connected to the floating member, wherein a single fastener passes through the support member, the auxiliary support member and the connection segment in the floating member.

12. The floating solar panel support assembly according to claim 1, comprising a first and a second support member, wherein also the second support member is coupled to the floating member and two respective panel mounting points different from the panel mounting points of the first support member.

13. The floating solar panel support assembly according to claim 12, wherein the first support member is arranged on a first half of the floating member, and wherein the second support member is arranged on the opposing second half of the floating member.

14. The floating solar panel support assembly according to claim 12, wherein the first support member couples to two panel mounting points at a first long side of the panel and wherein the second support member couples to two panel mounting points at a second long side of the panel, opposite the first long side.

15. The floating solar panel support assembly according to claim 12, comprising a first and a second auxiliary support member, wherein also the second auxiliary support member extends between the floating member and a mounting point of the solar panel at the non-zero distance.

16. The floating solar panel support assembly according to claim 1, wherein the floating member comprises a hollow body comprising a top surface and an opposing bottom surface, wherein the floating member comprises at least one connection section for coupling the support member, wherein at a connection section the top and bottom surface are coupled allowing a fastener to pass without intersecting the internal volume.

17. The floating solar panel support assembly according to claim 16, wherein a connection section comprises a conical segment extending from the bottom surface towards the top surface connecting the bottom surface and the top surface.

18. The floating solar panel support assembly according to claim 17, wherein the supporting structure is connected to the floating member by means of a plurality of fasteners, wherein any of the fasteners connecting the supporting structure to the floating member comprise threaded fasteners with a diameter larger than the diameter of a corresponding mounting hole in the floating, wherein the one or more fasteners connecting the supporting structure to the floating member are at least partially made of a relatively harder material, and the floating member is at least partially made of a relatively softer material, wherein the fastener forms threading in the corresponding mounting hole when the fastener is screwed into the mounting hole.

19. A floating member for use in the floating solar panel support assembly according to claim 1.

20. A kit of parts comprising a floating member and a support member and optionally a solar panel for assembling the floating solar panel assembly of claim 1.

* * * * *